United States Patent [19]

Godfrey

[11] 3,958,804

[45] May 25, 1976

[54] BILLIARD GAME TABLE

[76] Inventor: Eric G. Godfrey, 830 NW. 174 St., Miami, Fla. 33169

[22] Filed: Nov. 16, 1973

[21] Appl. No.: 416,691

[52] U.S. Cl. ..... 273/6; 273/3 A; 273/9; 273/12; 273/59 R; 273/123 R; 273/DIG. 26

[51] Int. Cl.[2] ..... A63D 15/00; A63D 15/20

[58] Field of Search ..... 273/2, 3 R, 3 A, 4 R, 273/4 A, 9, 5 R, 6, 12, 14, 123 R, 124 R, 125 R

[56] References Cited

UNITED STATES PATENTS

| | | | |
|---|---|---|---|
| 602,358 | 4/1898 | Perry | 273/123 R |
| 718,353 | 1/1903 | Ireland | 273/123 R |
| 771,210 | 9/1904 | Sausen | 273/123 R |
| 811,148 | 1/1906 | Johnson | 273/123 R |
| 835,177 | 11/1906 | Callahan | 273/3 A |
| 1,151,470 | 8/1915 | Kade | 273/5 R |
| 1,552,469 | 9/1925 | Conway | 273/123 R |
| 1,622,156 | 3/1927 | Kornahrens | 273/123 R |
| 3,466,038 | 9/1969 | Hill | 273/14 |

*Primary Examiner*—Richard J. Apley
*Assistant Examiner*—Richard T. Stouffer

[57] ABSTRACT

A billiard game table including a plurality of specially located rail pockets separated from each other by a series of carom cushions which extend over the game table surface. A plurality of separately identifiable balls are used with the game table, each of which has an associated initial playing position locator spot on the game table playing surface and a designated pocket spaced therefrom. Each of these balls must initially be caromed against at least one of the carom cushions, because there is no straight path from the locator spot to the designated pocket associated with each ball. Also included with the game table is an eye ball socket and a cue ball locator spot. Associated with the eye ball socket is an eye ball and an eye ball locator spot. The eye ball locator spot and the cue ball locator spot are separated from each other by the eye ball socket. So that the game table may be used either with or without the eye ball, a removable and replaceable plug is provided for the eye ball socket.

4 Claims, 7 Drawing Figures

BILLIARD GAME TABLE

OBJECTS OF THE INVENTION

It is an object of this invention to provide a specially modified billiard or pool table with specially located rail pockets separated from each other by carom cushions which extend over the conventional game table surface in a series of reverse and special curves, including one straight line portion, and with the pockets specially located to provide a game of skill in which two players compete against each other to see who can pocket the most balls in any designated consecutive manner, to amass the highest number of points and incur the least number of penalty points; the game, in one form, culminating and finishing with a single or multi-cushion carom shot that impels a specially designated ball into a specially designated socket or pocket in the table surface rather than in a side or end rail.

A further object of this invention is to provide a billiard game table of basically conventional construction, but its wall pockets located differently than in a conventional billiard game table, with its carom cushions extending over part of the table surface in a series of reverse curves, with a total of eight pockets rather than the conventional six, with the pockets located in the side and end rails rather than at the corners and at the mid-points of the side rails.

A further object of this invention is to provide a specially constructed billiard game table wherein carom cushions are of conventional material and construction, but extending from the outer sides of the specially located pockets in curves and other shapes, with a single pocket in each side rail, a pair of spaced apart pockets in the head rail separated by a pointed arch, and two pairs of pockets in the foot rail, the pockets of each pair being separated by a frusto-conical shaped cushion and the pairs separated from each other by a cushion shaped like a segment of a circle.

A further object of this invention is to provide an interesting and novel billiard game table wherein identified balls having initial playing position locator spots on the game table playing surface must initially be caromed against cushions extending over the table surface as there is no straight path from the locator spot to the designated pocket for that individual object ball.

Yet a further object of this invention is to provide a special eye ball and an eye ball socket or pocket in the playing surface of the table, with the cue ball locator spot, the eye ball locator spot and the eye ball socket or pocket in a straight longitudinal line centrally of the table parallel to the long sides of the table, the eye ball socket being between the cue ball locator spot and like eye ball locator spot.

A further object of this invention is to provide an extremely challenging and unique billiard game necessitating the utmost skill in the playing of the game.

A further object of this invention is to provide a billiard game table that may be built with or without a socket or a pocket extending through the playing surface of the table, and, further, when built with such pocket or socket, is provided with a removable and replaceable plug for the socket or pocket, so that it may be used either way.

BRIEF DESCRIPTION OF THE FIGURES

With the above and related objects in view, this invention consists in the details of construction and combination of parts, as will be more fully understood from the following description when read in conjunction with the accompanying drawing, in which.

DETAILED DESCRIPTION OF THE INVENTION

Figure 1:
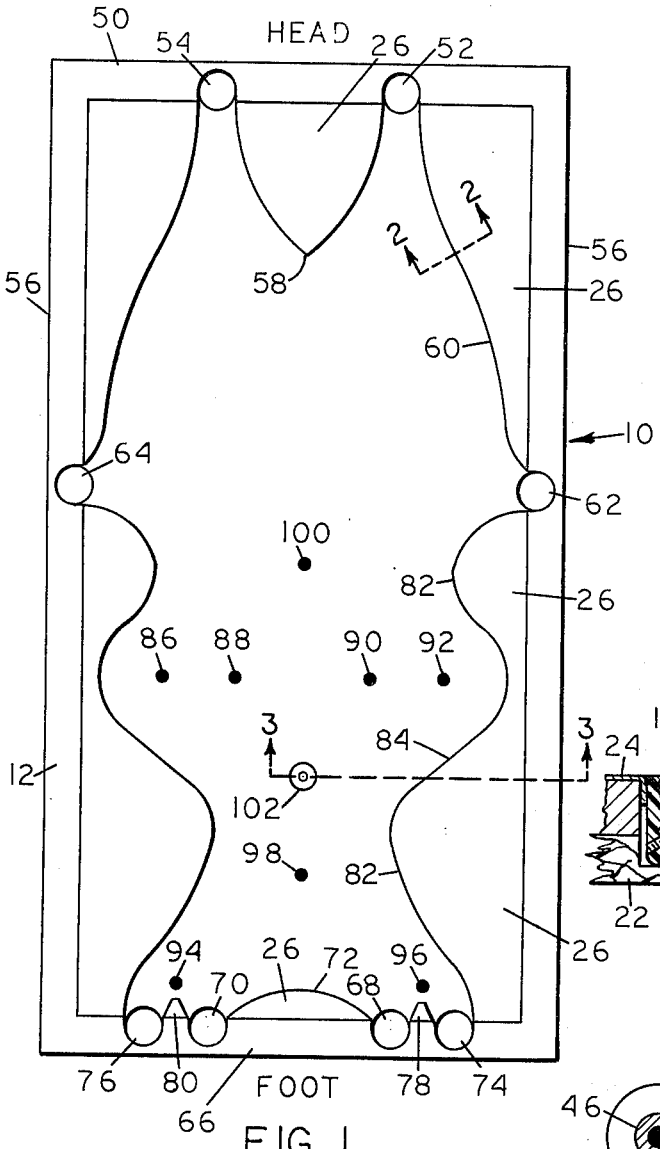
FIG. 1 is a plan view of the billiard game table of this invention.

There is shown at 10 the eye ball billiard game table of this invention. This table 10 may be of conventional billiard table size, that is, 10 by 5 feet; or 9 by 4 feet 6 inches; or 8 by 4 feet. The height is 31 to 32 inches as measured from the floor to the lowest point of the rail cap 12. Obviously, these dimensions may be varied, as desired, but the ratio shown above of length to width as two to one is preferred.

Cushions 14 of conventional cross section shape and materials, as shown, are covered with felt 16, and provide the usual contact line 18 standard in all billiard game tables, extending over the usual 1 inch slate bed 20 resting on suitable support 22 and provided with the usual smooth closely woven cloth 24 with the nap extending to the foot end of the table. The bed 20 may be of any other suitable natural material or synthetic material.

While the usual rail is straight and closely parallel to the sides and end of the table in conventional billiard game tables, one of the essences of this invention is that cushioned rails 14 are not straight along the sides. Instead, the particular curves and reverse curves shown are symmetrical on the opposite long sides of the table, incongruous on the opposite head and foot ends of the table, and the pockets are not at the mid-point of the sides and at the corners, but, again, are located as shown.

Cushion backing fillers 26 suitably shaped as shown are provided between the resilient cushions 14 and the rail sides 28 under the rail caps 12 and extend forwardly from the outer sides of each pocket to the outer sides of the next adjacent pocket.

Figure 5:
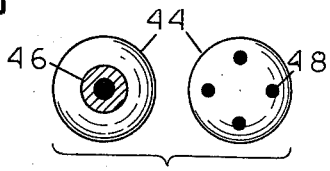
FIG. 5 is a plan view of the two hemispheres of the eye ball.
Figure 6:
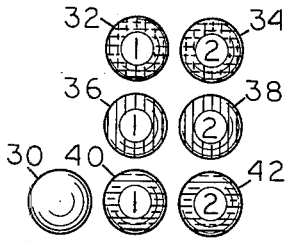
FIG. 6 is a plan view of the cue ball and other six identified object balls, on a small scale, used with the table of this game.

There are eight pockets, as shown. There are also eight balls, each of conventional size and material, including a white cue ball 30, six identified object balls 32, 34, 36, 38, 40 and 42, all shown in FIG. 6, and an eye ball 44 shown on a larger scale in FIG. 5. Object balls 32, 36 and 40 each have the numeral 1 thereon, repeated enough times so that the numeral may always be visible, while object balls 34, 38 and 42 have the numeral 2 thereon, repeated as necessary. Balls 32 and 34 are colored gold, 36 and 38 are colored red, and 40 and 42 are colored pink. The eye ball 44 has a large representation of a human eye 46 on one hemisphere of it, and four spots 48 at predetermined intervals quartering the other hemisphere.

Each of the eight balls has its own locator spot, preferably colored and identified, embedded in the surface of the table, and at the beginning of a game, each ball is set up on its designated locator spot.

The table 10 is provided with eight ball receiving pockets, two in the head rail 50 consisting of a right head pocket 52, the target for gold 1 ball 32, and a left head pocket 54, target for gold 2 ball 34. The two pockets 52 and 54 are located in the head rail 50 about equidistant from each other and from the two side rails 56, being separated from each other by a pointed arch-shaped cusion 58 extending to the inner sides of each pocket 52 and 54. A reverse curve cushion 60 extends from the outer side of each pocket 52 and 54 to the near side of a pocket 62 and 64 in the left and right side rails 56. Right side pocket 62 is the target for red 1 ball 36, and left side pocket 64 is the target for red 2 ball 38. The side pockets 52 and 64 are located somewhat less than one half the distance between the head rail 50 toward the foot rail 66.

The foot rail 66 has two pairs of ball receiving pockets, the right inner pocket 68 and left inner pocket 70 being penalty pockets, and are separated from each other by a cushion 72 shaped like a segment of a circle. The inner pockets 68 and 70 are separated from the outer pockets 74 and 76 by frusto-conical cushions extending from the foot rail 66 a distance equal to about slightly less than the diameter of a ball. A reverse curve cushion 82, which also includes a straight line portion 84, extends from the near side of left and right pockets 62 and 64 to the near sides of outer foot pockets 74 and 76. Outer right foot rail pocket 74 is the target for pink 2 ball 42, while outer left foot rail pocket 76 is the target for pink 1 ball 40. The ball locator spots for these six object balls are each so situated on the table surface with relation to their target pockets that a straight path the width of the diameter of a ball will necessarily intersect one curved cushion, so that the ball must be invariably caromed to reach its target pocket if played from its locator spot. The locator spots for both gold and both red balls are in a straight transverse line extending across the table surface about the center of the curve between the straight line portion 84 and the inwardly extended curved cushion toward the side pockets 62 and 64.

Extending from left to right, there is a locator spot 86 for red 1 ball 36, spot 88 for gold 1 ball 32, spot 90 for gold 2 ball 34 and spot 92 for red 2 ball 38. Pink 1 ball 40 locator spot 94 is situated in the conical center line just over the radius of a ball from the frusto-conical cushion 80 and pink 2 ball 42 locator spot 96 is similarly situated at frusto-conical cushion 78.

The straight line portion 84 is tangent to the curves it connects. An extension of straight line portion 84 would extend to the outer edges of the opposite right and outer left rail pockets 74 and 76, and would intersect in the longitudinal center line of the table 10. It is at this point that the locator spot for cue ball 30 is situated.

A foul line may be shown, extending transversely of table 10, through the cue ball locator spot 98. Interesting games and rules therefore may be devised for playing on the game table 10, with the six object balls and cue ball thus far described, but a most interesting game and rules hereinafter disclosed also utilizes an eye ball 44 and eye ball locator spot 100 on the same center longitudinal line of the table just about midway between the head rail 50 and the foot rail 66, together with an eye ball socket 102 also in the same center longitudinal line and between the cue ball spot 98 and the eye ball spot 100, the eye ball socket 102 being about one third the distance from the cue ball spot 98 toward the eye ball spot 100. The eye ball socket may obviously be a modified pocket in the same form as any of the rail pockets dropping into a chute leading to a side of the table.

Figure 3:
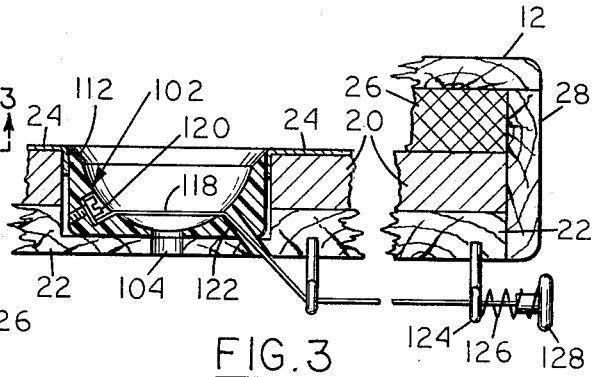
FIG. 3 is a section through the eye ball receiving socket, on line 3—3 of FIG. 1.

In the preferred socket form shown in detail in FIG. 3, the socket 102 is a formed composite insert press-fitted into a hole counterbored in the table 10 and through the slate support 22. The cavity in the socket 102 is of a depth not greater than the radius of the ball, with a hole 104 through its bottom for receiving the threaded stem 106 of a socket closing plug 108 complementary to the shape of the socket 102 and provided with a cloth covering at the top similar to the cloth 24 and chamfered at its edge 110 complementary to a chamfer 112 in the top edge of socket 102. A wing nut 114 and washer 116 are provided for closing the socket 102 and for providing a substantially smooth play surface for games not utilizing the eye ball and socket. A similar closing plug may be provided for a ball pocket used instead of the socket.

A socket ball lifting tape 118 is anchored by screw 120 in one side of the socket and extends through a slot 122 and eyes 124, through a coil spring 126 attached to a handle knob 128. When pulled, the tape 118 lifts the ball in the socket 102 for ready manual gripping, and, when released, the tension coil spring pulls back the handle knob 128.

Figure 7:
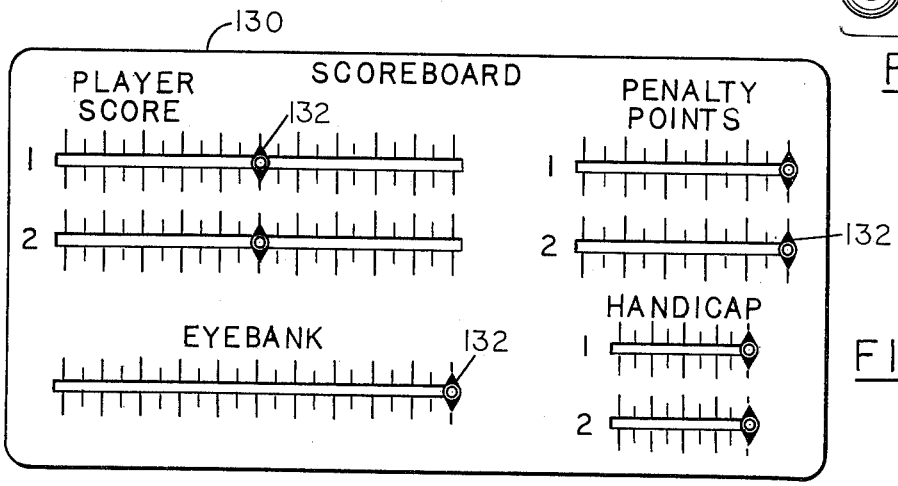
FIG. 7 is a plan view of a score board, that may be used in the play of the game.

A scoreboard 130, shown in FIG. 7, may be provided for keeping score in accordance with the following rules for playing a game utilizing the eye ball and eye ball socket or pocket. The scoreboard includes sliding pointers 132 and suitable indicia, not shown, cooperating with the pointers 132.

SCORING AND DESIGNATED SEQUENCE OF POCKETING BALLS:
(See FIG. 1)

| | | POINTS |
|---|---|---|
| | Gold 1 ball into Right Head Pocket | 50 |
| | Gold 2 ball into Left Head Pocket | 50 |
| | Pink 1 ball into Outer Left Foot Pocket | 75 |
| | Pink 2 ball into Outer right Foot Pocket | 75 |
| | Red 1 ball into Right Side Pocket | 125 |
| | Red 2 ball into Left Side Pocket | 125 |
| | * The eye ball into the eye socket | 500 |
| | * See game rule 12(a) | |
| PENALTIES: | (Resulting in loss of points by player incurring such penalty) | POINTS |
| (1) | Strike cue ball twice with cue | 25 |
| (2) | Cue ball, object ball, or any other ball struck by object ball or cue ball, in inner right or inner left foot pocket | 250 |
| (3) | Cue ball, object ball, or any other ball struck by object ball or cue ball strikes the eye ball (except where the eye ball is object ball). The eye ball to be replaced on locator spot | 100 |
| (4) | Player moves Pink 1 ball or Pink 2 ball from locator spots | 25 |
| (5) | Cue ball, object ball, or any other ball struck by object ball or cue ball goes into pocket other than that designated. (For inner left and inner right foot pockets, see Penalty No. 2). Balls to be replaced on specific locator spots | 25 |
| (6) | Cue ball beyond foul line (only at start of game, playoff, or replacement of cue ball) | 50 |
| (7) | Cue ball, object ball, or any other | |

-continued

| SCORING AND DESIGNATED SEQUENCE OF POCKETING BALLS: (See FIG. 1) | | POINTS |
|---|---|---|
| | ball struck by object ball or cue ball, goes into the eye socket, (except where object ball is the eye ball) | 50 |
| (8) | Cue ball fails to strike object ball | 25 |
| (9) | Any ball hit off table | 50 |
| (10) | Both feet off floor when making shot | 25 |

SCOREBOARD:

(See FIG. 7. Can be operated manually or electrically).

Figure 2:
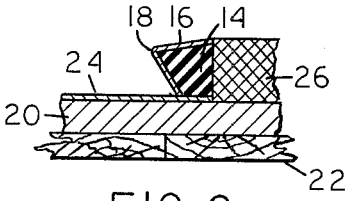
FIG. 2 is a section through cushion and table construction, on line 2—2 of FIG. 1.
Figure 4:
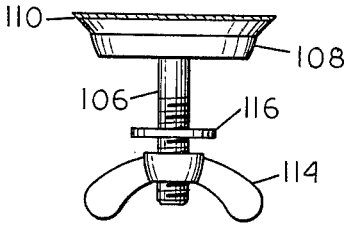
FIG. 4 is an elevation of a plug insertable, when desired, into the eye ball socket for providing an unbroken table surface.

Scoreboard will show:

a. Specific scores of each player;

b. Total penalty points assessed against each player;

c. Total of points in "EYEBANK";

d. In match or tournament play, total of points allocated to player who sockets the eye ball. (See Game Rule 12(*a*) and FIG. 2).

RULES OF GAME: Copyright 1973 by Eric G. Godfrey

1. Game shall be played by two players.
2. Each player shall start with 1,000 points. (See Scoreboard, FIG. 7).
3. At the start of each game, balls shall be set up on locator spots (See FIG. 1).
4. Each player shall be required to strike the cue ball with the cue tip in such a manner as to attempt to impel the object ball into the designated pocket in the designated order;
   a. Should cue ball go into any pocket, cue ball shall be replaced on cue ball locator spot. (See Penalties)
   b. After start of game and, with the exception of Game Rule 4(a), the cue ball shall be played from where it stops its forward motion.
5. Each player upon successfully pocketing object ball in designated order, shall be permitted to attempt to pocket the next designated object ball immediately thereafter.
6. Players are permitted to use direct cue shots, (i.e., cue ball to object ball) in the above endeavor, except where the eye ball is object ball.
7. Should player, using direct shot, fail to pocket object ball in designated pocket, the next player shall take his turn at the table.
8. If player impels object ball with cue ball by making a single or multiple cushion carom shot, he shall be permitted to make another shot (direct, single or multiple cushion carom) immediately thereafter (except where object ball is the eye ball.
9. Only single or multiple cushion carom shots are permitted when player endeavors to impel the eye ball into the eye socket.
10. Should player, using single cushion carom shot, not succeed in impelling the eye ball into the eye socket, the opposing player shall take his turn at the table.
    a. If player impels the eye ball with cue ball by making a multiple cushion carom shot, he shall be permitted to make another shot (single or multiple cushion carom) immediately thereafter.

11. When player successfully pockets an object ball in the designated order, his score shall be increased by the number of points allocated to the specific pocket and ball. (See Scoring) His opponent's score is, at the same time, debitted the same amount of points, (e.g., Players score stands at 1,000 points each. First player pockets Gold 1 in Right Head Pocket; Scoreboard should read: First Player 1050 — Second Player 950).
12. The player who successfully impels the eye ball into the eye socket shall be allocated 500 points, plus all the points in the "EYEBANK."
    a. In MATCH or TOURNAMENT PLAY, when the eye ball is in the eye socket, the allocation of points to the successful player shall be governed by the degree of exposure of the blank half of the eyeball. For the purpose of determining such allocation, four spots have been placed at predetermined locations on the blank half of the eye (See FIG. 5). Allocation shall be as follows:

| | | |
|---|---|---|
| No quarter dot showing | 500 | Points |
| One quarter dot showing | 450 | " |
| Two quarter dots showing | 400 | " |
| Three quarter dots showing | 350 | " |
| Four quarter dots showing | 300 | " |

13. When player incurs a Penalty, his score is debitted the specific amount of points allocated to that penalty (See Penalties). The scoreboard will show that amount in total with other penalties the player may have incurred in the Penalty Box opposite player's score. The amount of penalty points will also be added to the total number of points in the EYEBANK, which shall, at all times, show the total amount of PENALTY POINTS incurred by both players (See scoreboard, FIG. 7).
14. Should player not strike the designated object ball with the cue ball, he shall be penalized 25 points and the next player shall take his turn at the table.
15. In the event of a tied game, both players will mutually determine who makes the first shot and the player winning the decision will place the eye ball on any one of the ball locator spots and the cue ball on its locator spot. He can then commence the play with an endeavor to impel the eye ball into the eye socket using a single or multiple cushion carom shot.
    a. If player impels the eye ball by using a multiple cushion carom shot, he shall be permitted to make another single or multiple cushion shot immediately thereafter.
    b. Should player make a single cushion carom shot and fail to strike the eye ball or fail to socket the eye ball, the next player shall take his turn at the table.
    c. Should player impel the eye ball or the cue ball into any other pocket than the eye socket, the opposing player shall be declared the winner.
    d. The first player to socket the eye ball shall be declared the winner, (except where Rule No. 15(c) applies).
16. In tournament or match play, where a skillful player is matched against a player of lesser skill, there shall be permitted a system of handicapping. The handicap shall be allocated to each player based upon his performance over a period of time, and shall be subject to change, should player's skill warrant such change. The proven skillful player shall be rated at 0. Players of lesser skill shall be allocated a handicap of from 25 to 100, in 25 point increments, as justified by their degree of skill.

a. At the start of a game, where each player has such an allocated handicap, the difference in such handicaps shall be deducted as points from the player with the least handicap and added to his opponent's total points on the scoreboard.

b. Each player's handicap shall be shown in the respective indicators on the scoreboard (See FIG. 7).

SIMULATED GAME: (Showing method of scoring)

Player 1: Pockets gold 1 into Right Head Pocket and Gold 2 into Left Head Pocket; however, in trying to strike Pink 1 his cue ball goes into Inner Left Foot Pocket; Scores 100 Points; is Penalized 250 Points; Scoreboard reads: Player 1= 850; Player 2= 900; Eyebank= 250; Player 1 Penalty Box= 250; Player 2 Penalty Box 000.

Player 2: Places cue ball on locator spot, makes his shot and pockets Pink 1, and with his next shot fails to strike Pink 2; Scores 75 points; is penalized 25 Points; Scoreboard reads: Player 1= 775; Player 2= 950; Eyebank=275; Player 1 Penalty Box 250; Player 2 Penalty Box 25.

Player 1 pockets Pink 2 and Red 1, and his cue ball strikes the eye ball. Scores 200 points; is penalized 100 points. Scoreboard reads: Player 1=875; Player 2=750; Eyebank=375; Player 1 Penalty Box 350; Player 2 Penalty Box 25. The eye ball is replaced on locator spot.

Player 2. Cue ball misses Red 2 and goes into the eye socket. Scores 00; is penalized 50 points. Scoreboard reads: Player 1=875; Player 2=700; Eyebank=425. Player 1 Penalty Box=350; Player 2 Penalty Box 75. Cue ball is replaced on locator spot.

Player 1 pockets Red 2 and fails to socket the eye ball. Scores 125 points; is penalized 000. Scoreboard reads: Player 1=1,000; Player 2=575; Eyebank=425; Player 1 Penalty Box 350; Player 2 Penalty Box 75.

Player 2 sockets the eye ball. Scores 500 points plus all points in eyebank. Scoreboard reads: Player 1=500; Player 2=1,500. Player 2 declared winner.

It will be noted that at all times the total number of points is 2,000. Points can be given a value of 1 cent up to whatever the traffic will bear. In the above simulated game each player could have started with a $1,000, $100 $10 on the line. Player 1 would have lost $500, $50, $5; Player 2 would have won $500, $50, $5, in direct relation to the amount of the stake.

ABSTRACT OF THE DRAWING

In the drawing, like numbers refer to like parts, and for the purpose of explication, set forth below are the numbered parts of this improved billiard game table and balls.

10 table
12 rail cap
14 resilient cushion
16 felt on 14
18 contact line on 14
20 slate bed
22 slate bed support
24 smooth woven cloth over slate bed
26 backing fillers for cushions 14
28 rail sides
30 white cue ball
32 gold 1 ball
34 gold 2 ball
36 red 1 ball
38 red 2 ball
40 pink 1 ball
42 pink 2 ball
44 eye ball
44 human eye representation 44 on one hemisphere of 44
48 four quartering spots on other hemisphere of 44
50 head rail
52 right head rail pocket, target for gold 1 ball 32
54 left head rail pocket, target for gold 2 ball 34
56 two side rails
58 pointed arch shape cushion extending from head rail 50
60 reverse curve cushion between pockets 52 and 62
62 ball pocket in right side rail 56, target for red 1 ball 36
64 ball pocket in left side rail 56, target for red 2 ball 38
66 foot rail
68 foot rail right inner penalty pocket
70 foot rail left inner penalty pocket
72 segment shaped cushion at foot rail
74 foot rail outer right pocket, target for pink 2 ball 42
76 foot rail outer left pocket, target for pink 1 ball 40
78 frusto-conical cushion between pockets 68 and 74
80 frusto-conical cushion between pockets 70 and 76
82 reverse curve cushion from pocket 62 to 74
84 straight line portion of 82
86 locator spot for red 1 ball 36
88 locator spot for gold 1 ball 32
90 locator spot for gold 2 ball 34
92 locator spot for red 2 ball 38
94 locator spot for pink 1 ball 40
96 locator spot for pink 2 ball 42
98 locator spot for cue ball 30
100 locator spot for eye ball 44
102 socket or pocket, target for eye ball 44
104 hole through bottom of socket 102
106 threaded stem of plug 108
108 socket closing plug
110 chamfer on closing plug 108, complementary to chamfer 112
112 chamfer in top edge of socket 102
114 wing nut for threaded stem 106
116 washer on stem 106
118 socket ball lifting tape
120 tape anchoring screw
122 slot for tape
124 eyes for tape
126 tension coil spring about tape
128 handle knob on end of tape, attached to tape 118 and adjacent eye 124
130 scoreboard
132 sliding pointers on scoreboard Although this invention has been described in considerable detail, such description is intended as being illustrative rather than limiting, since the invention may be variously embodied.

Having thus set forth and disclosed the nature of this invention, what is claimed is:

1. A substantially rectangular billiard game table having a playing surface including a plurality of interconnected playing areas thereon, said playing surface being encompassed by a head end rail, a foot end rail, and two side rails, said side rails each being substantially longer than either of said head end rail or said foot end rail, said head end rail having only one pair of spaced ball pockets located therein, said head end rail pockets being spaced about equidistantly from said side rails and from each other, each of said side rails having only one ball pocket located therein, each said one ball pocket being located somewhat nearer said head end rail than said foot end rail, two spaced apart pairs of closely adjacent pockets located in said foot end rail, said spaced apart pairs being substantially spaced from each other and each of said pairs being substantially spaced from the one of said side rails adjacent thereto, cushion means for cushioning a ball hit thereagainst extending inwardly over said table surface from each of said rails, said cushion means between said pockets of said head end rail being in the form of an arch, said cushion means between each pocket within each of said pairs of pockets of said foot end rail being frustoconical in shape and of less length, from base to apex, than the diameter of a conventional size billiard ball, said cushion means between each of said spaced apart pairs of pockets of said foot end rail being in the shape of a segment of a circle, said cushion means between said head end rail and said foot end rail extending from the side of each of said spaced apart pairs of pockets most closely adjacent one of said side rails to said side pocket in said one of said side rails and from there to said pocket in said head end rail most closely adjacent said one side rail, said cushion means between said head end rail pocket and said side rail pocket being in the form of reverse curves, said cushion means between said each of said spaced apart foot end rail pockets and said side rail pocket also being in the form of reverse curves but including one straight line portion, a plurality of initial ball locator spots permanently imprinted on said table surface, one of said spots being a cue ball locator spot located on the longitudinal center line of said table surface, another one of said spots being a center ball locator spot located on the center of said table surface, the other of said locator spots each having a corresponding one of the ball pockets in one of the side or end rails serving as a target pocket therefor, all the other of said other of said locator spots being so located that a straight path centered thereon of a width equal to the diameter of a conventional billiard ball from said other of said other of said locator spots to said target pockets intersects one of said cushion means.

2. The table of claim 1 and a ball socket located in the longitudinal center line of the table surface at a point approximately one third of the distance from said cue ball locator spot toward said center locator spot.

3. The table of claim 2, and means for releasing a ball from said center line socket.

4. The table of claim 3, and plug means for filling said center line socket to provide a smooth playing surface thereover when so desired.

* * * * *